US008667619B2

(12) United States Patent
Roberts et al.

(10) Patent No.: US 8,667,619 B2
(45) Date of Patent: Mar. 11, 2014

(54) WATER SAVING FLAPPER VALVE WEIGHT APPARATUS

(76) Inventors: Terrance Monty Roberts, Fayetteville, AR (US); Brad Waldack, Fayetteville, AR (US)

( * ) Notice: Subject to any disclaimer, the term of this patent is extended or adjusted under 35 U.S.C. 154(b) by 436 days.

(21) Appl. No.: 12/930,694

(22) Filed: Jan. 13, 2011

(65) Prior Publication Data

US 2011/0203042 A1 Aug. 25, 2011

Related U.S. Application Data

(63) Continuation-in-part of application No. PCT/US2009/004778, filed on Aug. 21, 2009.

(60) Provisional application No. 61/189,596, filed on Aug. 21, 2008.

(51) Int. Cl.
*E03D 1/35* (2006.01)

(52) U.S. Cl.
USPC ..... 4/395

(58) Field of Classification Search
USPC ..... 4/353, 395, 378, 415
See application file for complete search history.

(56) References Cited

U.S. PATENT DOCUMENTS

| | | | | |
|---|---|---|---|---|
| 4,419,773 | A | 12/1983 | Sullivan | 4/392 |
| 5,031,250 | A * | 7/1991 | Garcia De Couto | 4/366 |
| 5,129,110 | A | 7/1992 | Richter | 4/324 |
| 5,333,332 | A * | 8/1994 | Kam | 4/326 |
| 5,966,749 | A | 10/1999 | Goesling et al. | 4/392 |
| 6,112,763 | A * | 9/2000 | Orbell | 137/398 |
| 6,742,194 | B2 * | 6/2004 | Shim | 4/325 |
| 7,661,438 | B2 * | 2/2010 | Nichols-Roy et al. | 137/411 |
| 7,937,782 | B2 * | 5/2011 | Vosler | 4/324 |
| 8,185,976 | B2 * | 5/2012 | Le et al. | 4/324 |

* cited by examiner

*Primary Examiner* — Lori Baker
(74) *Attorney, Agent, or Firm* — Keisling & Pieper PLC; David B. Pieper

(57) ABSTRACT

A water saving device for a toilet adapted for mounting on an overflow tube above a flapper valve. The device uses a mainframe connected to the overflow tube to position a highchair that is pivotally mounted to the mainframe. A water cup is mounted to the highchair for weight and a vertical cam descends from the highchair to contact and close the flapper valve.

10 Claims, 4 Drawing Sheets

WATER SAVING FLAPPER VALVE WEIGHT APPARATUS

CROSS-REFERENCE TO RELATED APPLICATIONS

This application claims priority to and is a continuation-in-part of U.S. application Ser. No. 61/189,596 entitled Wizard Water Saver, filed Aug. 21, 2008 and PCT US2009/004778 filed Aug. 21, 2009 entitled Wizard Water Saver.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to the field of water efficiency in waste disposal. In particular, the present invention relates specifically to a user controllable counter weight for a toilet flapper valve adaptable to different flapper designs and toilet arrangements.

2. Description of the Known Art

As will be appreciated by those skilled in the art, toilets and flapper valves are well known. Historically when one flushes a 1.6 gallon or larger gallon capacity toilet, the entire amount of the water in the toilet holding tank is used with every flush. The user cannot use less water than that held in the holding tank. As such, primarily in urine flush but occasionally in a feces flush as well, the amount of water uses is far in excess of what is needed to clear those materials down the trap as the majority of gravity fed flopper designed toilets will flush urine as well as some small amounts of feces with less water than that held in the holding tank and delivered during a regular flush.

Patents disclosing information relevant to flapper valves include the following:

U.S. Pat. No. 7,661,438, issued to Nichols-Roy, et al. on Feb. 16, 2010 entitled Water saver fill valve and assembly. The abstract reads as follows: An improved fill valve has a pivot valve body that is pivotally suspended immediately below a float housing and is movable between two positions. In a first position, the pivot valve body blocks the flow of water from the float housing. In a second position, the pivot body allows the flow of water from the float housing. The pivot valve body has two top compartments, each separated from the other by a wall. The first compartment retains an amount of water in it. The second compartment functions as a water flow restriction apparatus and includes an upwardly-extending member for sealing off a check valve that is disposed within the bottom of the float housing. The fill valve also includes structural elements that allow the water to trickle into the float housing at a very slow rate. The fill valve can be re-set for normal toilet tank operation.

U.S. Pat. No. 6,742,194, issued to Shim on Jun. 1, 2004 entitled Dual capacity flush valve assembly for a toilet. The abstract reads as follows: A dual-flush flapper valve assembly, set for a normally short flush, is provided for use with a pivoting flapper valve in a flush tank. The assembly comprises a weight, which moves back and forth along a guide relative to the flapper's pivot point. The moveable weight, if activated, temporarily reduces the turning moment arm of the flapper for ensuring a long flush. The assembly further comprises an actuator to trap and release the weight, resulting in either a short flush (when the weight is remote from the pivot) or a long flush (when the weight is close to the pivot). The flapper assembly is engageable through a resistance force, for selectively triggering the actuator, shifting the weight and resulting in a long flush. After a long flush the assembly resets for a short flush, until activated once again.

U.S. Pat. No. 5,966,749, issued to Goesling, et al. on Oct. 19, 1999 entitled Adjustable flush valve. The abstract reads as follows: A pivotable toilet flush valve member (10) is provided, of the type that includes a float (40) with a pair of holes (44, 52) that allow the float to fill with water during a flushing to close early, and where the float can be turned to vary the amount of water used during a flushing, wherein the float is constructed for easy and loose mounting on a frame (12) and for low friction rotation about a primarily vertical axis (60), and where the flush valve member has a simple detent mechanism to hold the float at any rotational position to which it is turned. The frame has an aperture (74) lying along the primarily vertical axis, and the float has a small diameter upwardly extending projection (70) that projects upwardly through the frame aperture and that is held by the walls of the aperture, for low friction turning. The detent mechanism includes an upstanding wall (100) with an upwardly-open vertical groove (102) that has a plurality of teeth on at least one side of the groove. The frame has a downwardly-extending detent (92) with at least one tooth (111-113) that lies in the groove.

U.S. Pat. No. 5,129,110, issued to Richter on Jul. 14, 1992 entitled Selectable toilet-water-level flushing system. The abstract reads as follows: A selectable toilet-water-level flushing system (10) that allows a toilet user to selectively control the quantity of water that is used for a toilet flush. The quantity of water used depends on whether liquid or solid waste is to be flushed. For liquid waste, only a partial flush is necessary; for solid waste, a full-flush is used. The system (10) functions by performing a simple modification to the toilet flush valve (12). The modification consists of inserting into the valve opening a weight (16) that causes the normally buoyant valve to become non-buoyant. Since the valve is non-buoyant, the lifting of the valve from the valve seat (36) is totally controlled by the toilet flush handle (38) which, in turn, is controlled by the user. Typically, for a partial flush the handle (38) is temporarily held in its depressed position for two seconds while for a full flush, it is held for four seconds. Over a period of time, by using partial flushes a large savings of fresh water can be realized.

U.S. Pat. No. 4,419,773, issued to Sullivan on Dec. 13, 1983 entitled Adjustable tank discharge valve for controlling flush water volume. The abstract reads as follows: A discharge valve closure of the type which has a bleeder port to permit the conservation of water by causing the closure to shut the discharge valve prior to the draining of all water from the water tank. The discharge valve closure features an adjustment which permits at least a portion of the buoyancy chamber to be pivoted about the axis of the closure to position the bleeder port at a selected angular spacing from its top dead center position. This adjustment allows the tank water level at which the closure shuts off the discharge valve to be adjusted.

Each of these patents is hereby incorporated by reference in their entirety.

Each of these constructions requires modification to the original manufacturer's design or replacement of components within the toilet. In contrast to these devices, the present invention allows one to convert the original single flush toilet to have the capability to function as a dual flush system for the purpose cutting the amount of water needed during flush modes without modifying the original flapper or toilet construction. Thus, the prior art has addressed the dual flush issue, but has failed to recognize the multiple different constructions of sizes and flapper valves in the multitude of original gravity fed flopper toilets. Thus the prior art has failed to provide a standard fix for the multitude of different flapper valve and drain size constructions.

SUMMARY OF THE INVENTION

This invention pertains to a standardized mechanical device which can be easily installed into any of the multitude of standard toilets including 1.6 gallon and larger capacity flush toilets without removing or modifying the original flapper valve construction or connections. The system uses an adjustable mount for installation of a mainframe on an overflow tube above the top of a flapper valve. A high chair is pivotally mounted to the mainframe and an adjustable capacity water cup is mounted to the high chair. One or more valve cams are also adjustably mounted to extend below the high chair. The valve cams are positioned to transfer the weight of the water cup to the top of the flapper valve for early closing of the flapper valve when desired. This allows for various sizes, shapes, and configurations of overflow tubes, flapper valve sizes, and flapper valve shapes to provide a consistent configuration for varying toilet designs. This solves the problem of using excessive amounts of water during flush modes with an easy to install component without requiring flapper valve modification, custom flapper valves for each toilet design, or modification of the original toilet design.

The embodiment of this invention will allow one to convert with ease their existing gravity fed flapper toilet which would allow the toilet to function as if it was a water saving dual flush toilet. With the embodiment of this invention one can create water saving dual flush toilets in two ways. First the low or urine flush can be accomplished by lightly pushing and then releasing the flush handle. This would activate the invented mechanism and render a regulated low flush thus saving water. Further the embodiment of this invention is such that the amount of water used in the low flush can be regulated by a simply adjustment of the mechanism. This allows one to save the maximum amount of water for their particular toilet design. The embodiment of this invention further allows for a water saving during a full or feces flush. This saving can be accomplished by holding the flush handle down just long enough for the material to clear the trap. Once cleared, the flush handle is released. The amount of water used will be no more or no less than is necessary for an adequate flush. Again water is saved. After the urine or feces flush cycle has been completed, the toilet would refill making ready for another low or full flush.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
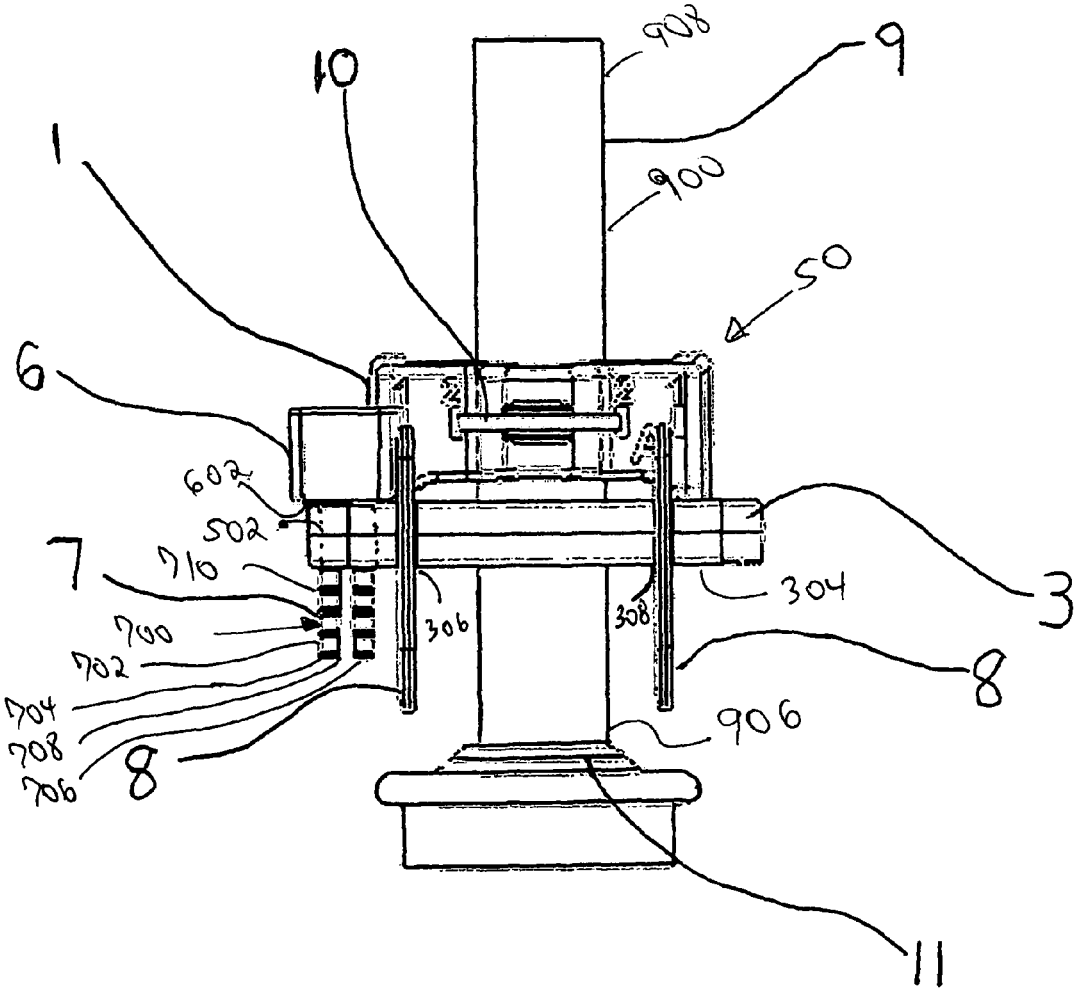
FIG. 1 is the front view of the water saving flapper valve weight apparatus attached to an overflow tube.

Looking at FIGS. 1 through 4 of the drawings, one can see the water saving device 50. The device 50 includes a mainframe 1 mounted to the overflow tube 9 using zip ties 10. The mainframe may also be attached using a adhesive, adhesive strip, integral snaps or screw mechanisms of any nature as well as any other means. The mainframe includes pins 2 that extend outward. The high chair 3 is attached to the mainframe 1 by fitting the pins 2 into pivot holes 4 in the highchair 3. A water cup 6 with a lower adjustable stem 7 is shown mounted to the left side of the high chair 3 by inserting the adjustable stem 7 into the cup hole 5 in the high chair. Vertical adjustment cams 8 are also mounted to the high chair 3. The vertical adjustment cams 8 are positioned to contact the flapper seal 11 to force the flapper seal 11 it to close when the water cup 6 has been filled with water.

The mainframe 1 includes a mainframe body 100 defining a central pipe recess 102 and extending arms 104 with protruding hands 106 to fit various sizes and shapes of overflow tubes 9. Generalized mounting is provided by securing the overflow tube 9 into the central pipe recess using the inner mounting apertures 108 for small pipes or the outer mounting aperture 110 for larger diameter pipes. Note that the mainframe 1 can be moved very close to the flapper seal 11 because the bottom of the mainframe 1 includes a lower flapper recess 112.

Figure 2:
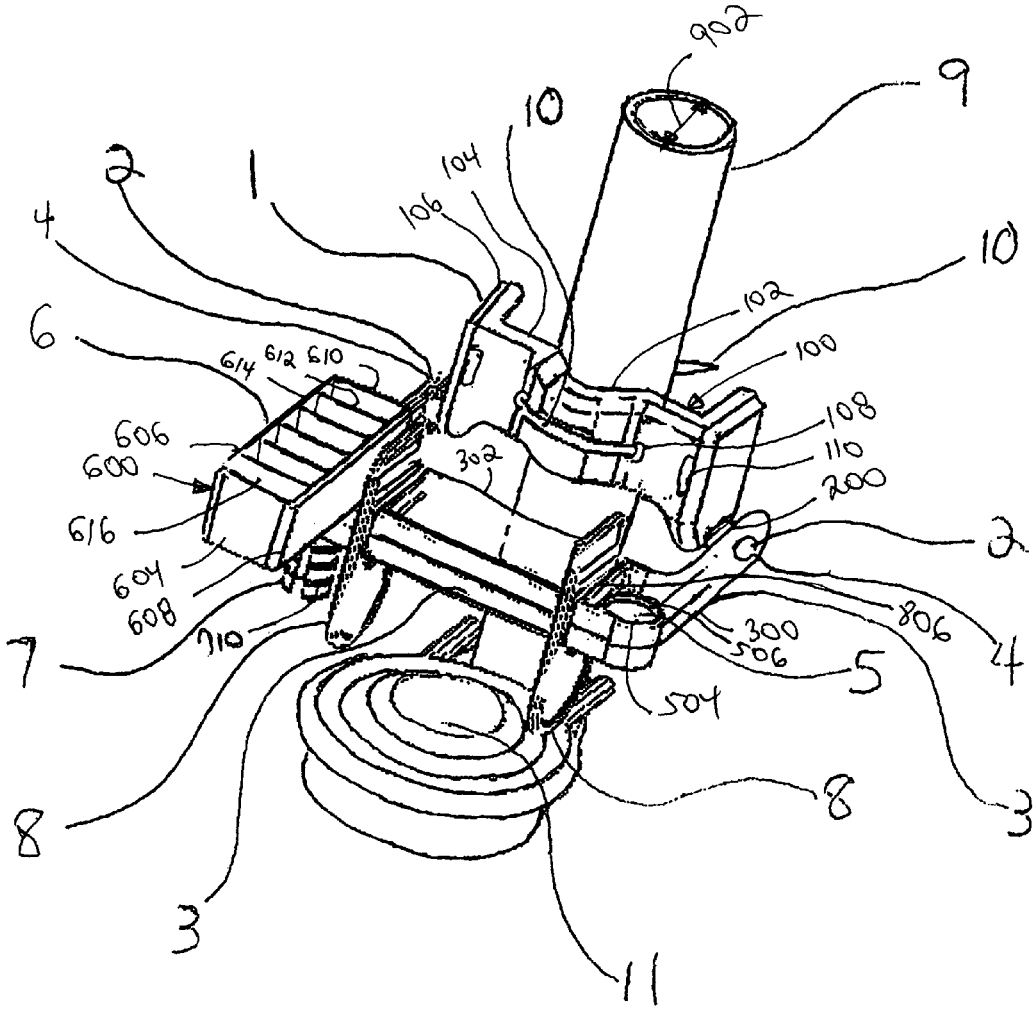
FIG. 2 is a perspective view of the weight apparatus attached to an overflow tube.
Figure 3:
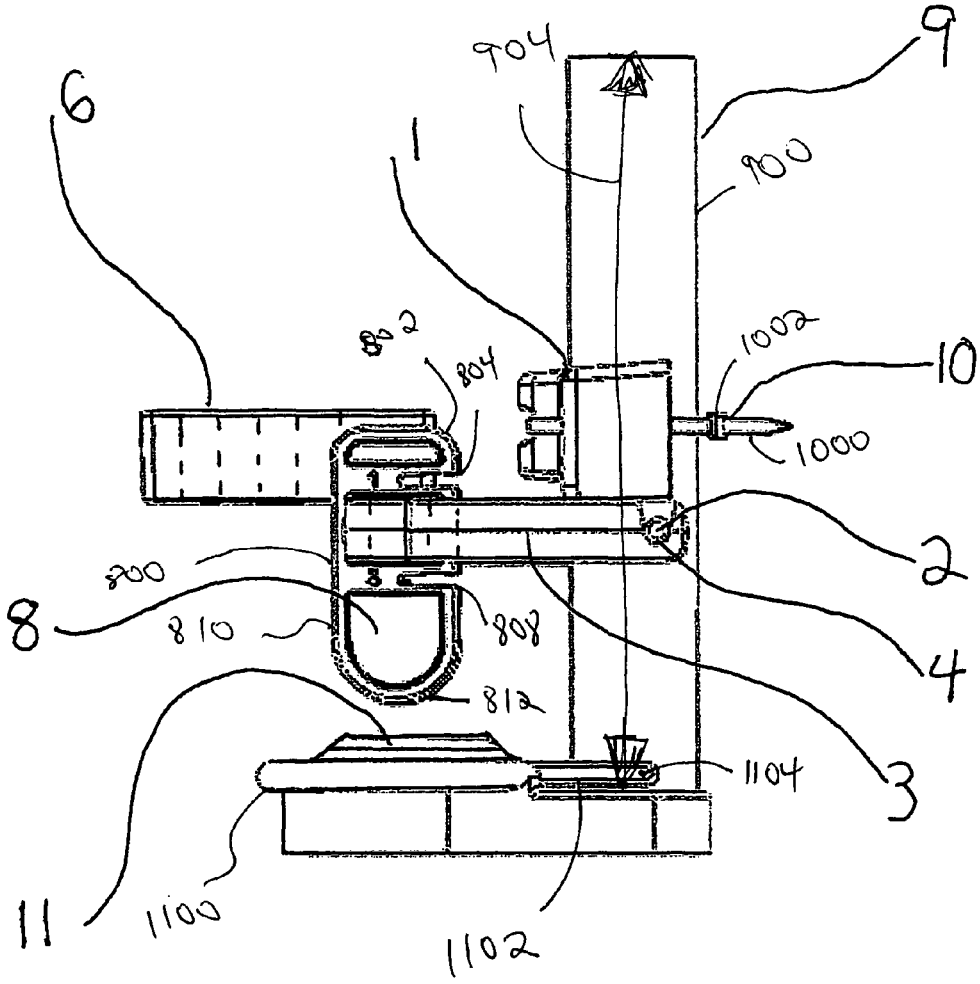
FIG. 3 is a right side view of the weight apparatus attached to an overflow tube.
Figure 4:
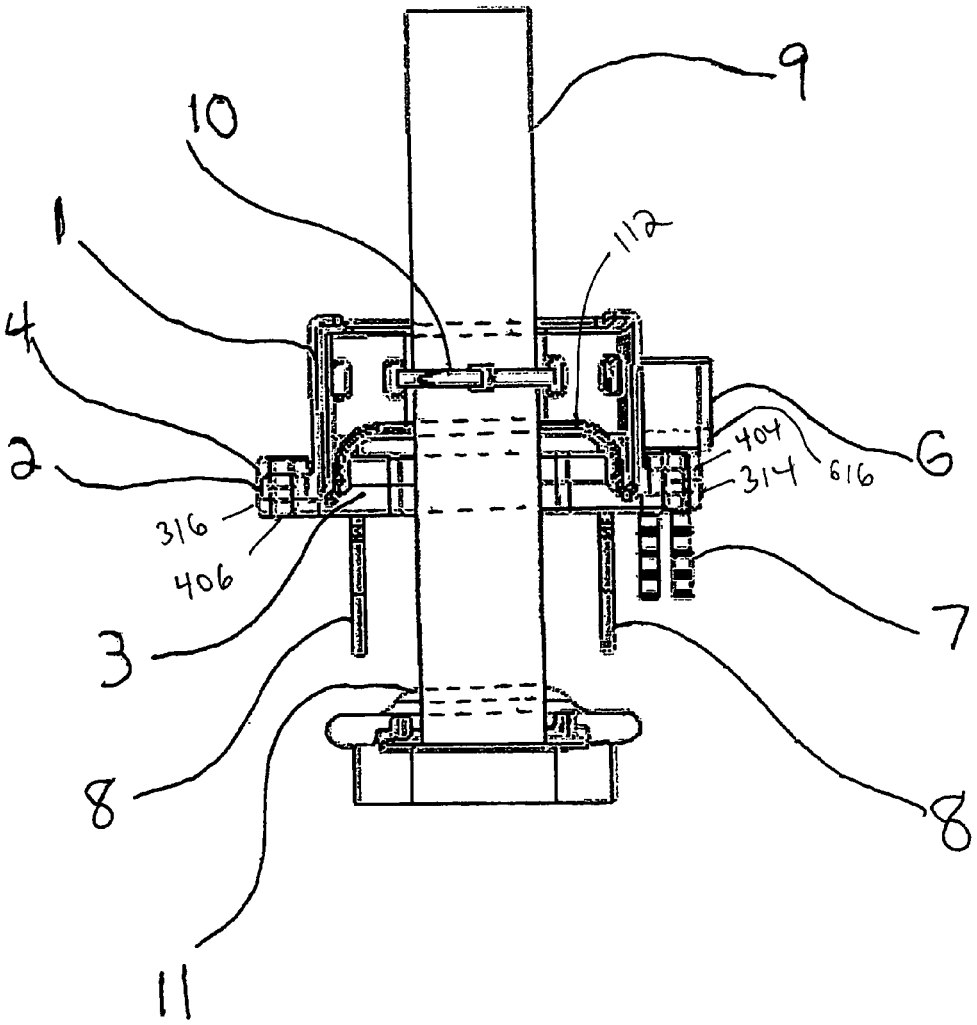
FIG. 4 is a back view of the weight apparatus attached to an overflow tube.

The pins 2 include a pin body 200 adapted to pivotally connect into the pivot holes 4. The pins 2 are formed as identical mirrored protruding pins with each extending outward from the bottom and most back trailing edge of the left and right outermost vertical sides of mainframe number 1 as shown in FIG. 2.

The highchair 3 includes a highchair body 300 including a horizontal cross arm 302 and a vertical cross arm 304. The vertical cross arm defines both a left cam connection slot 306 and a right cam connection slot 308 connecting the cams 8. The highchair body 300 also includes a left hinge arm 314 and a right hinge arm 316 connected to the horizontal cross arm 302 to pivotally mount the high chair body 300. The highchair 3 is restrained in the horizontal position by contacting the mainframe body 100. The left hinge arm 314 includes a left pivot hole 404 and the right hinge arm 316 includes a right pivot hole 406. The holes 4 are found on each side of the trailing most end of highchair number 3 as shown in FIG. 2.

Also defined by the highchair are the cup holes 5. The cup holes allow for either left or right mounting of the water cup 6 using either the left cup hole 502 or the right cup hole 504. Each of the cup holes 502, 504 include a leg securing ridge 506 to hold the adjustable stem 7 in position. The cup holes 5 are found on each side of the most leading front edge of highchair number 3. Said holes 5 act as a female receptacle for the adjustable stem 7.

The water cup 6 includes a water cup body 600 having a bottom 602, a front wall 604, a left wall 606, a right wall 608, a back wall 610, and internal baffles 612 forming water holding apertures 614, the front air baffle 616, and the bottom air baffle 618.

The adjustable stem 7 is permanently attached to the water cup 6. The adjustable stem 7 includes an adjustable stem body 700 having a cup leg 702 formed from a left leg 704 and a right leg 706 separated by a leg compression slot 708 allowing for the legs to flexibly fit into either of the cup holes 5. Each leg 704, 706 defines leg indentations 710 that mate with the leg securing ridge 506 to hold the leg 704, 706 in position.

The cams 8 include a vertical adjustment cam body 800 having both an upper cam body 802 and a lower cam body 810. The cams 8 include multiple slots that allow for vertical adjustments to attach to the most frontal edge of highchair 3. The upper cam body 802 defines a first adjustment slot 804, second adjustment slot 806, and a third adjustment slot 808.

The lower cam body 810 defines a cam profile 812 that contacts the top 1106 of the flapper 10. The cams 8 rest approximately one half inch above the top surface of the flapper 11. The distance between the bottom most leading edge of the two cams and the top most leading edge of the flapper can be changed by either vertically adjusting the cams or by manually sliding the mainframe bracket 1 up or down the overflow tube 9. In FIG. 1, the two cams 8 are positioned over the flapper 11. The embodiment of this invention requires that the two cams number 8 be positioned so there will be equal pressure on both sides of the flapper 11 as it is raised during the flush mode.

The overflow tube 9 includes an overflow tube body 900 with an overflow body diameter 902 and an overflow body length 904 beginning at the lower overflow end 906 and extending to the upper overflow end 908.

The zip tie 10 includes a zip tie body 1000 with a zip tie head 1002. As is known in the prior art, the tie body 1000 includes ridges that mate with a biased finger pin in a slot in the zip tie head 1002.

The flapper 11 includes a flapper seal body 1100 with a flapper top 1106 and flapper hinge arms 1102 extending out to the flapper hinge 1104. The flapper hinge hingably connects the flapper 11 to the overflow tube 9 as is well known in the prior art. The flapper 11 rests directly over the drain. When the toilet is activated, the flapper 11 lifts up allowing water held in the holding tank to be released into the drain.

The embodiment of this invention is designed to function with the water in the toilet holding tank once the flush handle has been activated during the standard flush mode. As water begins to fill the toilet holding tank, the water reaches the bottom of the water cup 6. The front air baffle 616 and the bottom air baffle 618 of the water cup 6 trap an air bubble. As the water continues to rise the trapped bubble forces the water cup 6 to pivot upward and the water's connection to the highchair 3 forces the highchair 3 upward until it contacts the front of the mainframe 1. The highchair comes to rest as the most top and back area of the highchair comes in contact with the top leading edge of the mainframe. As the water continues to rise, the water flows over the top of water cup 6 and fills each of the five water holding apertures 614. The water continues to rise until the shutoff in the toilet activates.

Upon flushing the toilet the flush handle is pushed downward causing the flapper valve 9 to rise. The flapper 9 rises until the bubble of air trapped in the flapper 9 is released. With the majority of gravity fed flopper design toilets the amount of time to release the flapper bubble is such that the majority of water held in the holding tank is utilized.

The embodiment of this invention forces the flapper 9 to close prematurely before all the water in the holding tank has been dispelled thus using less water. This is accomplished by the added weight of the water in the water cup number 6. As previously noted, water is retained in the five rectangular apertures 614 at the top of the water cup 6. When the water level begins to fall, the added water weight in the water cup 6 along with the weight of highchair number 3 and the two cams number 8 prematurely force the flapper 9 to close reducing the amount of water used during that flush mode.

The embodiment of this invention allows for one to increase or decrease the amount of water used by adjusting the height of the device 50 on the outflow tube 9, the height of the water cup 6 attached to stem number 7 by moving stem number 7 upward or downward in hole number 5, and yet further adjustment by moving the two cams 8 vertically up or down utilizing one of three slots 804, 806, 808. After the water cup 6 and cams 8 have been adjusted to match the desired amount of water to be used, the toilet will then utilize a consistent amount of water for the low flush setting.

The embodiment of this invention allows the user to switch from the water saving mode to a flush mode requiring more water by simply holding the handle longer. To accomplish this, the user simply continues to hold down the flush handle which in turn prevents the flapper 11 from falling. As the flapper 11 is restrained, so also are the two cams 8 as well as highchair number 3 and water cup number 6. They will remain in this lifted position until released by the user. Once the flushed material clears the trap and the handle is released, the flapper 11 will immediately drop because it is still being pushed shut by the added water weight in the five water cup baffles 614 as well as the added weight of the cams 8 and highchair 3.

Reference numbers used in the application are provided as follows:

mainframe 1
pins 2
highchair 3
pivot holes 4
cup holes 5
water cup 6
adjustable stem 7
vertical adjustment cams 8
overflow tube 9
zip tie 10
flapper valve 11
water saving device 50
mainframe body 100
central pipe recess 102
extending arms 104
protruding hand 106
inner mounting aperture 108
outer mounting aperture 110
lower flapper recess 112
pin body 200
highchair body 300
horizontal cross arm 302
vertical cross arm 304
left cam connection slot 306
right cam connection slot 308
left hinge arm 314
right hinge arm 316
left hole 404
right hole 406
left cup hole 502
right cup hole 504
leg securing ridge 506
water cup body 600
bottom 602
front wall 604 left wall 606
right wall 608
back wall 610
internal baffles 612
water holding apertures 614
front air baffle 616
bottom air baffle 618
adjustable stem body 700
cup leg 702
left leg 704
right leg 706
leg compression slot 708
leg indentations 710
vertical adjustment cam body 800
upper cam body 802
first adjustment slot 804
second adjustment slot 806
third adjustment slot 808
lower cam body 810
cam profile 812
overflow tube body 900
overflow body diameter 902
overflow body length 904
lower overflow end 906
upper overflow end 908
zip tie body 1000
zip tie head 1002
flapper seal body 1100
flapper hinge arm 1102
flapper hinge 1104

Unless otherwise defined, all technical and scientific terms used herein have the same meaning as commonly understood by one of ordinary skill in the art to which this invention belongs. Although methods and materials similar to the equivalent to those described herein can be used in the practice or testing of the present invention, suitable methods and materials are described below. All publications, patent applications, patents and other references mentioned herein are incorporated by reference in their entirety to the extent allowed by applicable law and regulations. In the case of conflict, the present specification, including definitions, will control. The present invention may be embodied in other specific forms without departing from the spirit or essential attributes thereof and it is therefore desired that the present embodiment be considered in all respects as illustrative and not restrictive, reference being made to the appended claims rather than forgoing description to indicate the scope of the invention.

What is claimed:

1. A water saving apparatus for mounting on an overflow tube above a flapper valve, the device comprising:
a mainframe connectable to the overflow tube;
a highchair pivotally mounted to the mainframe;
a water cup mounted to the highchair;
at least one vertical cam mounted to the highchair, the at least one vertical cam positioned above the flapper valve; and
a zip tie connecting the mainframe to the overflow tube.

2. A water saving apparatus for mounting on an overflow tube above a flapper valve, the device comprising:
a mainframe connectable to the overflow tube, the mainframe including a mainframe body defining a central pipe recess;
a highchair pivotally mounted to the mainframe;
a water cup mounted to the highchair; and
at least one vertical cam mounted to the highchair, the at least one vertical cam positioned above the flapper valve.

3. A water saving apparatus for mounting on an overflow tube above a flapper valve, the device comprising:
a mainframe connectable to the overflow tube;
a highchair pivotally mounted to the mainframe, the highchair including a highchair body defining a vertical cross arm with at least one cam connection slot;
a water cup mounted to the highchair; and
at least one vertical cam mounted to the highchair, the at least one vertical cam positioned above the flapper valve.

4. The apparatus of claim 3, the at least one cam connection slot including a left cam connection slot and a right cam connection slot.

5. A water saving apparatus for mounting on an overflow tube above a flapper valve, the device comprising:
a mainframe connectable to the overflow tube;
a highchair pivotally mounted to the mainframe, the highchair including a highchair body defining at least one cup hole for mounting the water cup, the highchair including at least one cup hole including a leg securing ridge;
a water cup mounted to the highchair; and
at least one vertical cam mounted to the highchair, the at least one vertical cam positioned above the flapper valve.

6. A water saving apparatus for mounting on an overflow tube above a flapper valve, the device comprising:
a mainframe connectable to the overflow tube;
a highchair pivotally mounted to the mainframe;
a water cup mounted to the highchair, the water cup body including at least one water holding aperture; and
at least one vertical cam mounted to the highchair, the at least one vertical cam positioned above the flapper valve.

7. A water saving apparatus for mounting on an overflow tube above a flapper valve, the device comprising:
a mainframe connectable to the overflow tube;
a highchair pivotally mounted to the mainframe;
a water cup mounted to the highchair, the water cup body including an adjustable stem body, the adjustable stem body including a left leg and a right leg separated by a leg compression slot; and
at least one vertical cam mounted to the highchair, the at least one vertical cam positioned above the flapper valve.

8. A water saving apparatus for mounting on an overflow tube above a flapper valve, the device comprising:
a mainframe connectable to the overflow tube;
a highchair pivotally mounted to the mainframe;
a water cup mounted to the highchair, the water cup body including an adjustable stem body, the adjustable stem body defining leg indentations; and
at least one vertical cam mounted to the highchair, the at least one vertical cam positioned above the flapper valve.

9. A water saving apparatus for mounting on an overflow tube above a flapper valve, the device comprising:
a mainframe connectable to the overflow tube;
a highchair pivotally mounted to the mainframe;
a water cup mounted to the highchair; and
at least one vertical cam mounted to the highchair, the at least one vertical cam positioned above the flapper valve, the at least one vertical cam including an upper cam body defining at least one adjustment slot.

10. A water saving apparatus for mounting on an overflow tube above a flapper valve, the device comprising:

a mainframe connectable to the overflow tube;

a highchair pivotally mounted to the mainframe;

a water cup mounted to the highchair; and at least one vertical cam mounted to the highchair, the at least one vertical cam positioned above the flapper valve, the at least one vertical cam including a lower cam body defining a cam profile.

* * * * *